United States Patent [19]

Sibley

[11] Patent Number: 4,884,731

[45] Date of Patent: Dec. 5, 1989

[54] BACKPACK WITH DETACHABLE AUXILIARY PACKS

[75] Inventor: Paul T. Sibley, Boulder, Colo.

[73] Assignee: Coleman Outdoor Products, Inc., Wichita, Kans.

[21] Appl. No.: 214,318

[22] Filed: Jul. 1, 1988

[51] Int. Cl.[4] ..... A45F 3/04

[52] U.S. Cl. ..... 224/215; 224/202; 383/2; 383/37

[58] Field of Search ..... 224/153, 201, 202, 204, 224/205, 208–216, 231, 257–263, 272, 154–156, 264; 150/111–113; 190/108–111; 383/2, 37–40

[56] References Cited

U.S. PATENT DOCUMENTS

| | | | |
|---|---|---|---|
| 3,989,080 | 11/1976 | Koszegi | 383/40 |
| 4,059,207 | 11/1977 | Jackson | 224/31 |
| 4,236,657 | 12/1980 | Brunton | 224/153 |
| 4,466,124 | 8/1984 | Kirkham, Jr. | 383/2 |
| 4,491,258 | 1/1985 | Jones | 224/153 |

FOREIGN PATENT DOCUMENTS

| | | | |
|---|---|---|---|
| 55357 | 10/1923 | Sweden | 224/209 |
| 274643 | 4/1951 | Switzerland | 224/214 |

OTHER PUBLICATIONS

Marmot Mountain Works Catalog Fall/Winter 1984, p. 20.

*Primary Examiner*—Henry J. Recla
*Assistant Examiner*—J. Casimer Jacyma

[57] ABSTRACT

A backpack is provided with a pair of detachable auxiliary side packs. Each of the auxiliary side packs is connected to the main pack by multiple pairs of fasteners, and one fastener of each pair is connected to the main pack by an adjustable strap. The adjustable straps can be tightened to adjust the capacity of the auxiliary packs.

5 Claims, 3 Drawing Sheets

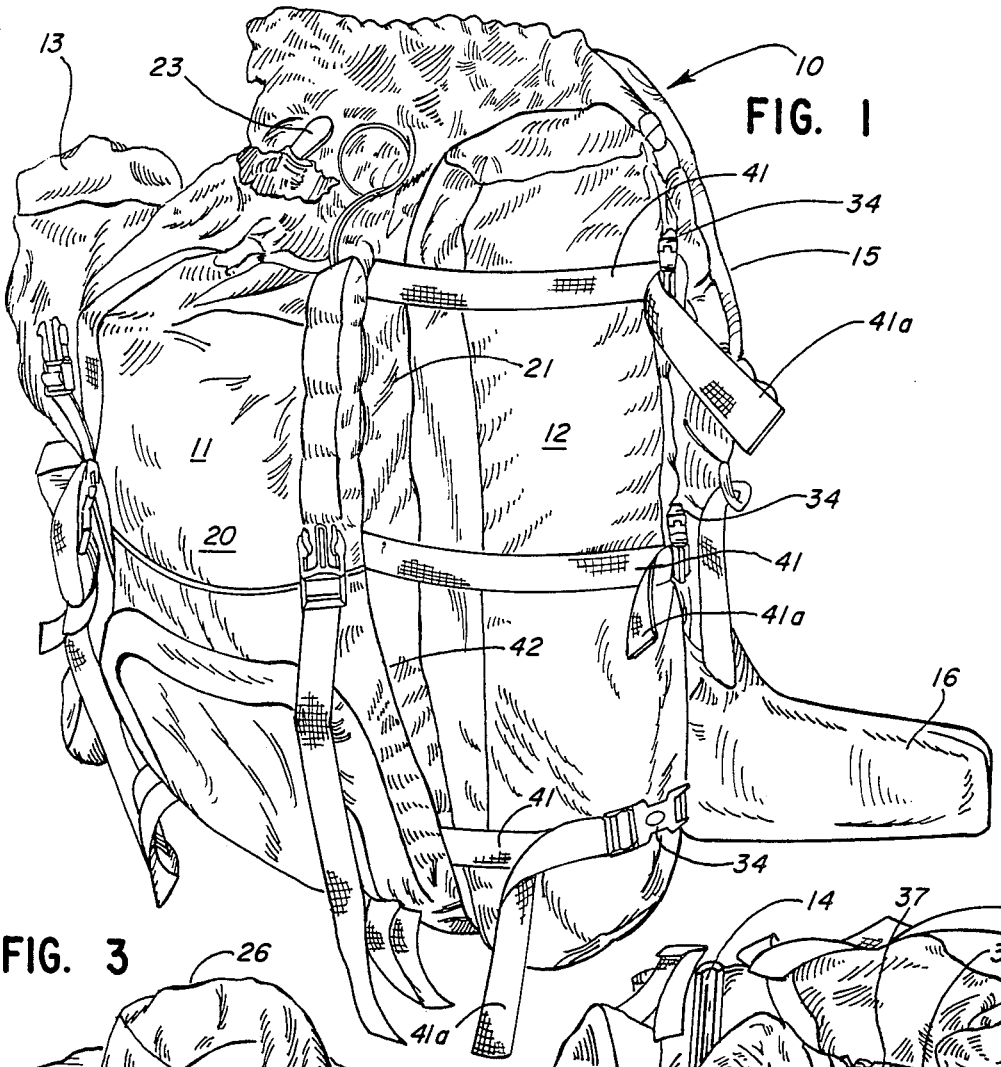
FIG. 1
FIG. 2
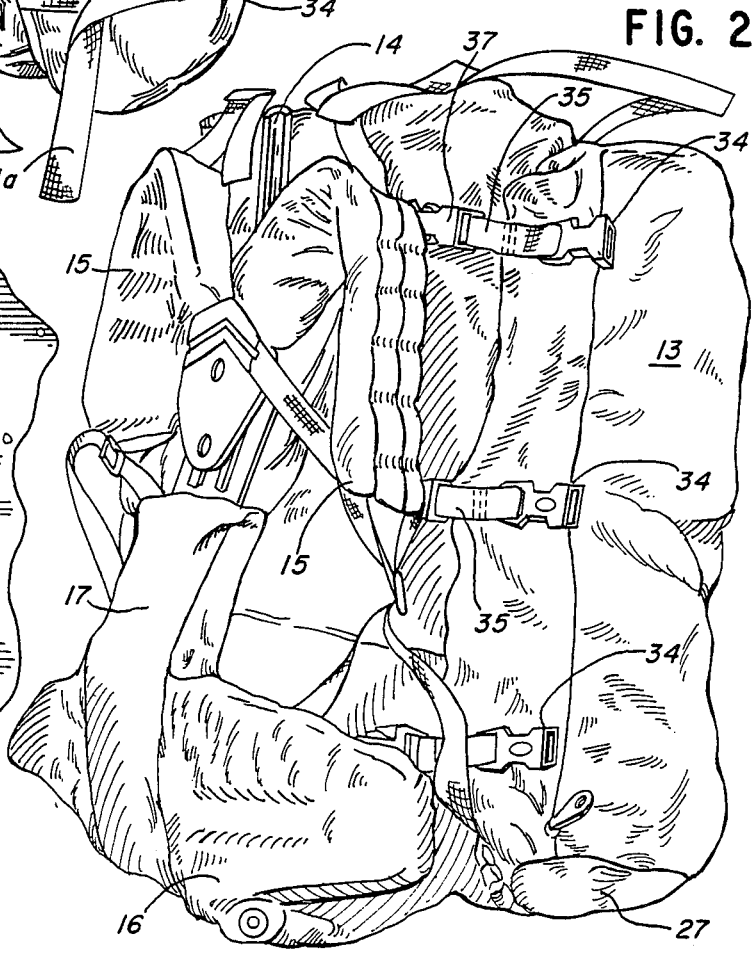
FIG. 3
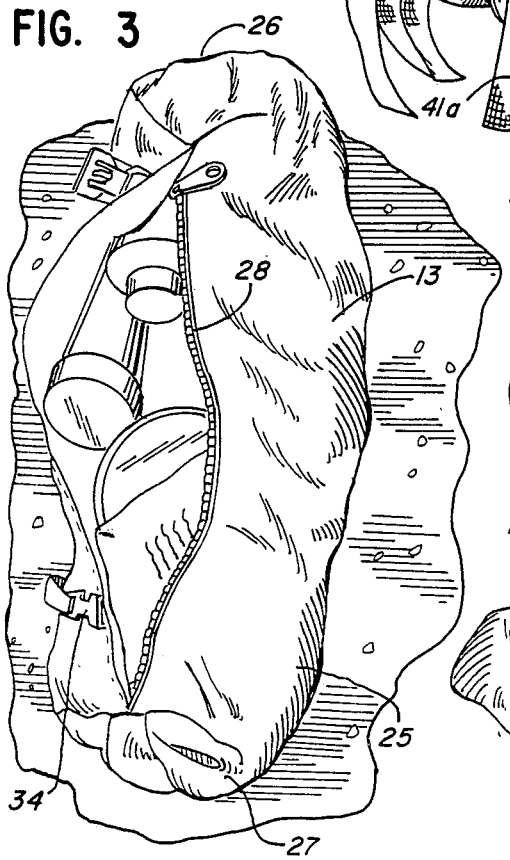

FIG. 7
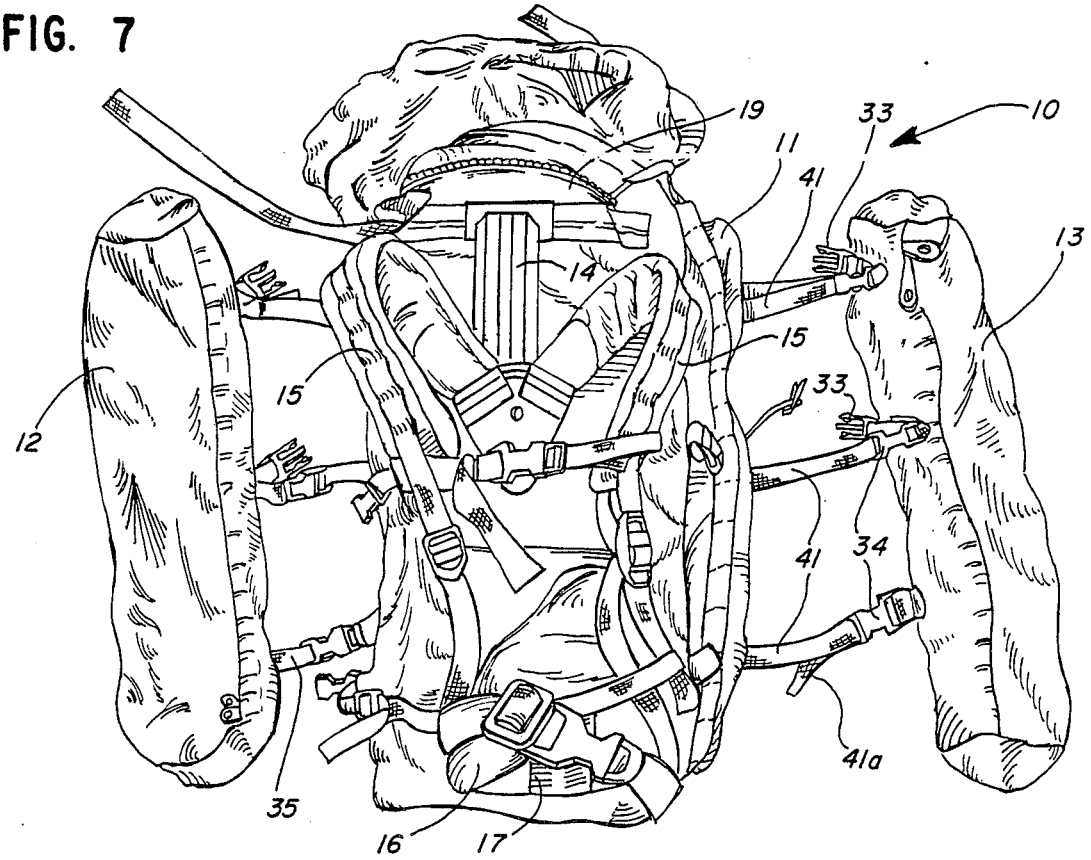
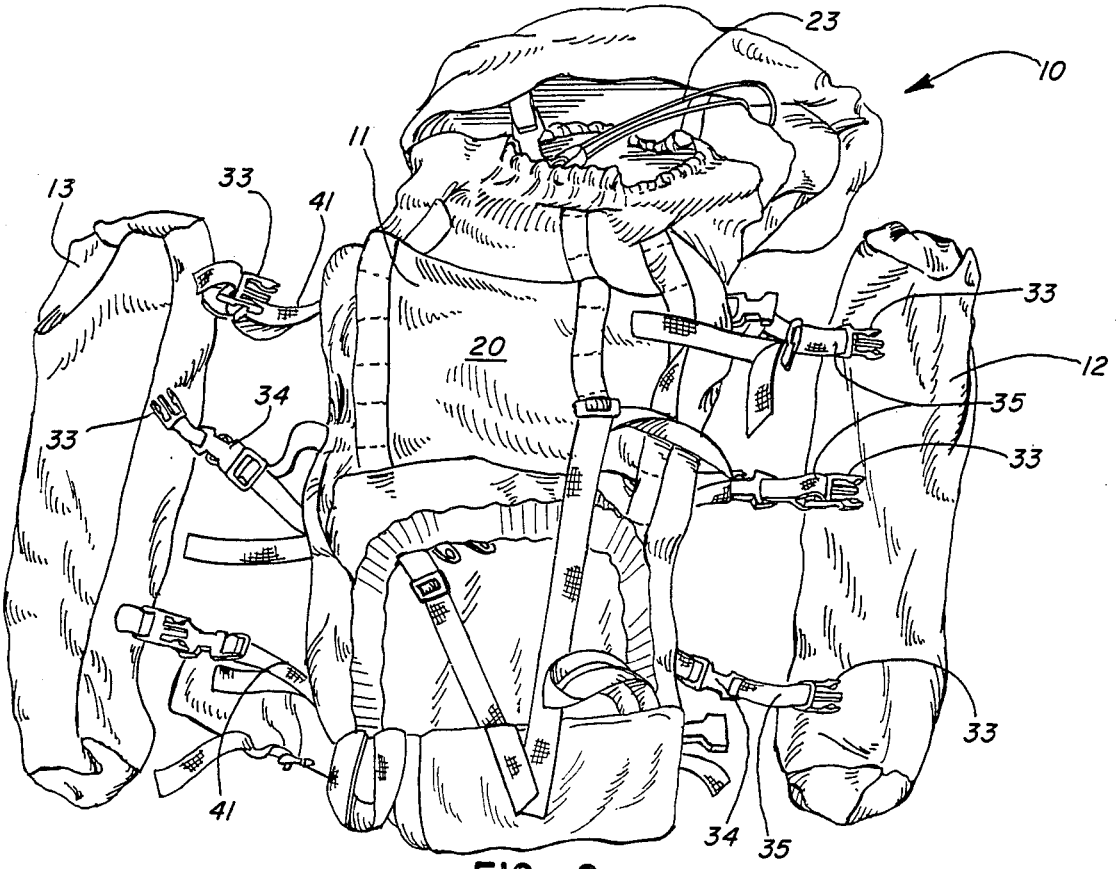
FIG. 8

BACKPACK WITH DETACHABLE AUXILIARY PACKS

BACKGROUND AND SUMMARY

This invention relates to backpacks, and, more particularly, to a backpack with detachable side compartments.

Backpacks generally include a frame and a pack which is mounted on the frame. It is often desirable to carry more articles than can fit into the pack. However, simply increasing the size of the pack is not necessarily desirable because on the occasions when a large capacity pack is not filled, the contents of the pack are not distributed uniformly and can shift within the pack.

Auxiliary packs have been provided, but the means for attaching and detaching the auxiliary packs is frequently cumbersome and time-consuming to operate. Further, if the auxiliary packs are not filled to capacity, the contents of the auxiliary packs can shift and cause the backpack to become unbalanced.

The invention provides a packpack with a main pack and a pair of auxiliary side packs which can be quickly and easily attached and detached to the main pack. The fastening means for the auxiliary packs are mounted on adjustable straps, and the capacity of the auxiliary packs can be adjusted merely by adjusting the length of the straps. The contents of the auxiliary packs can be removed without detaching the auxiliary packs from the main pack. When the auxiliary packs are removed, the adjustable straps can be used to adjust the capacity of the main pack.

DESCRIPTION OF THE DRAWING

The invention will be explained in conjunction with an illustrative embodiment shown in the accompanying drawing, in which FIG. 1 is a rear perspective view of the backpack;

FIG. 2 is a front perspective view of the backpack;

FIG. 3 is a fragmentary perspective view of one of the auxiliary packs removed from the main pack;

FIG. 7 is a front view of the backpack showing the auxiliary packs partially detached; and FIG. 8 is a rear view of the backpack showing the auxiliary packs partially detached.

DESCRIPTION OF SPECIFIC EMBODIMENT

Figure 4:
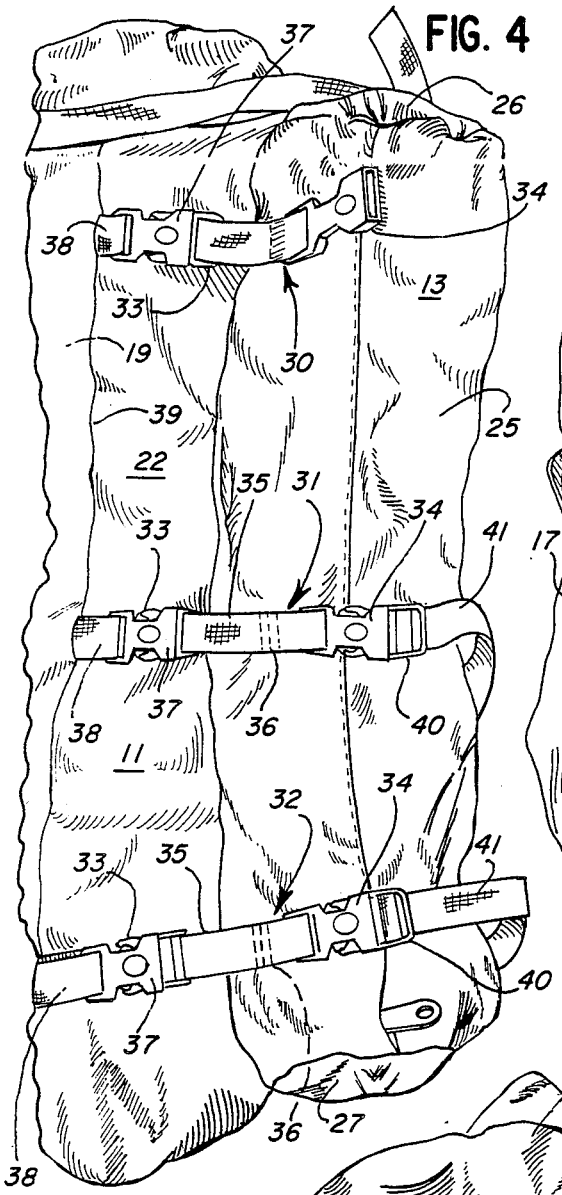
FIG. 4 is a fragmentary side view of the backpack.

A backpack 10 includes a main pack 11 and a pair of auxiliary or side packs 12 and 13. With the exception of the auxiliary side packs 12 and 13 and the means for attaching the auxiliary packs to the main pack, the backpack can be conventional. The particular backpack illustrated includes an external frame 14 (FIG. 7) which is attached to the front of the main pack. A pair of shoulder straps 15, a hip belt 16, and a lumbar pad 17 are attached to the frame.

Figure 6:
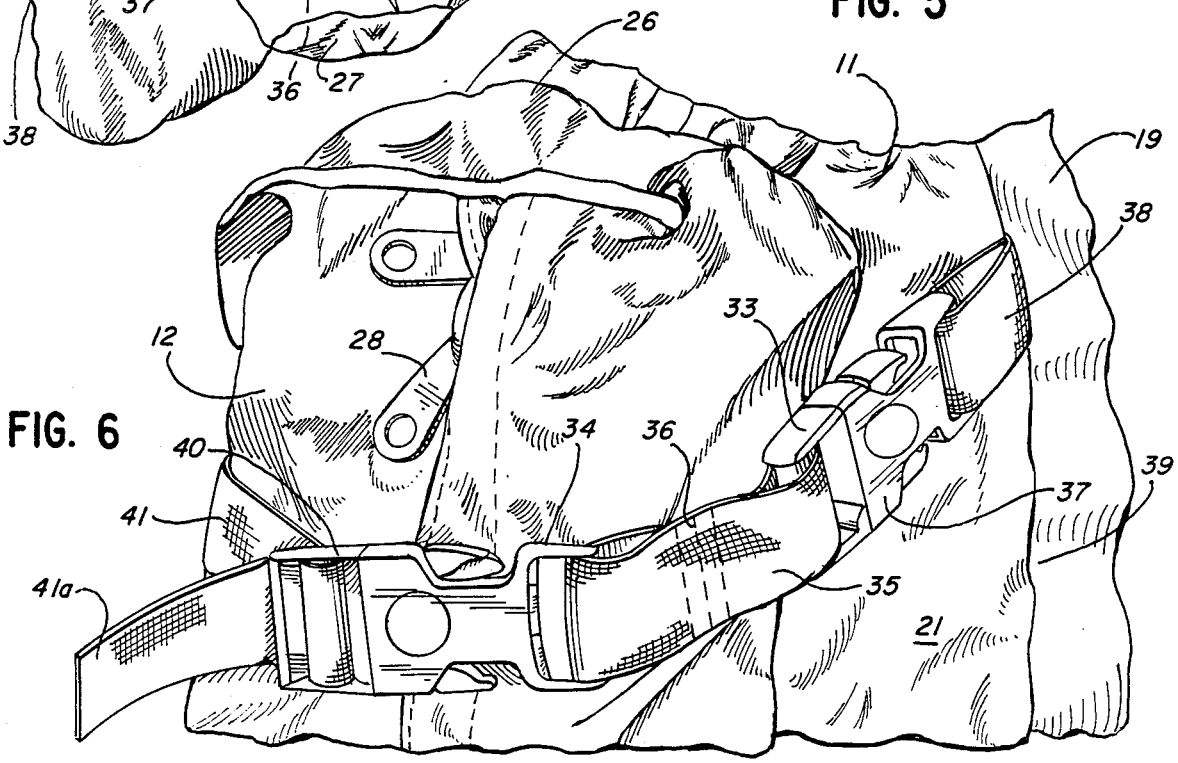
FIG. 6 is a fragmentary view of the upper portion of one of the auxiliary packs.

The main pack 11 can be formed from nylon or similar material and includes a front panel 19 (FIGS. 4, 6 and 7), a rear panel 20 (FIGS. 1 and 8), and right and left side panels 21 and 22 (FIGS. 1, 4, and 6). The panels are stitched together along vertical seams. The bottom of the main pack is closed by a bottom panel (not shown), and the open top of the main pack can be closed by a draw string 23 (FIGS. 1 and 8).

Referring to FIG. 3, each of the auxiliary side packs 12 and 13 is generally tubular in shape and includes a tubular side panel 25 and top and bottom panels 26 and 27 which are stitched to the side panel. The auxiliary packs can also be made of nylon or similar material. The auxiliary pack is opened and closed by a zipper 28.

Referring to FIG. 4, each auxiliary pack includes an upper fastening assembly 30, an intermediate fastening assembly 31, and a lower fastening assembly 32. Each of the fastening assemblies includes male and female fasteners 33 and 34 which are attached to a nylon strap or webbing 35. The strap 35 is secured to the auxiliary pack by stitching 36. The particular male and female fasteners 33 and 34 illustrated are of the type described in U.S. Pat. No. 4,150,464 and sold under the trademark FASTEX.

Each of the male fasteners 33 on the auxiliary packs is connected to a female fastener 37 which is connected to the main pack by a short nylon strap 38. The short straps 38 are inserted in the seams between the front panel 19 and the left and right side panels 21 and 22 of the main pack and are secured by the stitching which secures the seam 39 between the front and side panels.

Each of the female fasteners 34 on the auxiliary pack 13 is connected to a male fastener 40 which is attached to the main pack by an adjustable strap 41. As can be seen best in FIG. 6, the adjustable strap 41 is threaded through the pair of strap slots which are customarily provided on the fastener 40, and the length of the adjustable strap 41 can be adjusted by pulling on the free end **41*a* of the strap. The other end of the adjustable straps 41 are secured to the main pack in the seams 42 (FIG. 1) between the back panel 20 and right and left side panels 21 and 22**.

After each of the auxiliary packs is connected to the main pack by the fasteners, the adjustable strap 41 can be tightened to adjust the capacity of the auxiliary pack to its contents. The auxiliary packs are advantageous for storing numerous small articles, and the three adjustable straps which attach each auxiliary pack to the main pack can tighten the auxiliary pack at three separate locations to secure the contents of the auxiliary pack.

Figure 5:
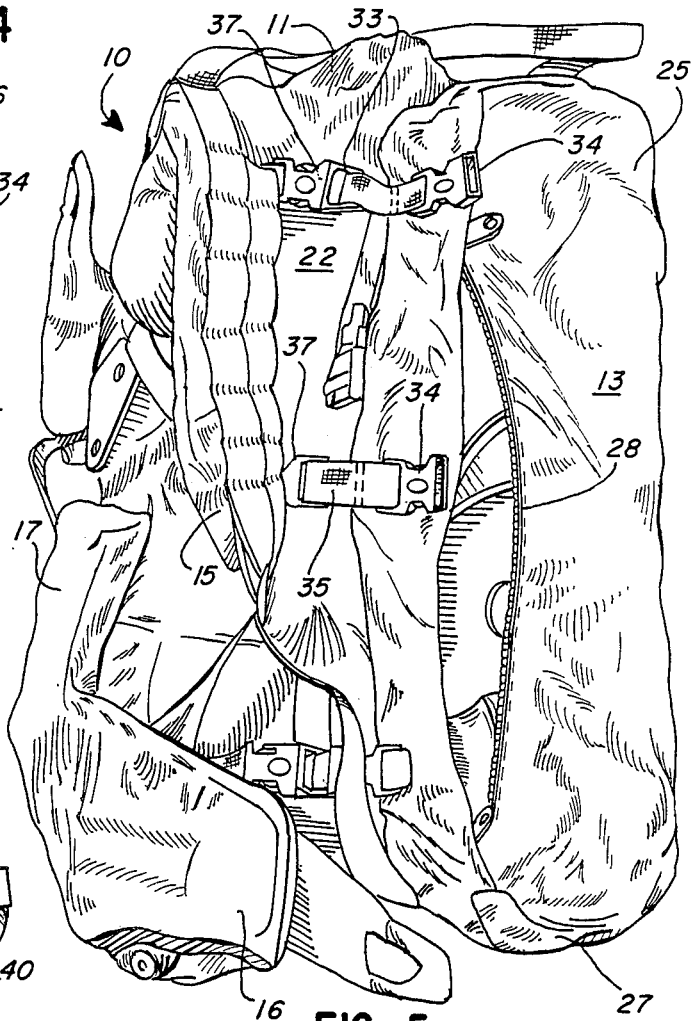
FIG. 5 is a view similar to FIG. 4 showing the auxiliary pack opened to provide access to the contents thereof.

FIG. 5 illustrates how access to the auxiliary pack can be gained without completely detaching the auxiliary pack from the main pack. The male fasteners 40 and adjustable straps 41 are disconnected from the female fasteners 34, but the auxiliary pack remains attached to the main pack by the connection between the fasteners 33 and 37. After the adjustable straps 41 are disconnected, the zipper 28 can be opened to provide access to the auxiliary pack.

The auxiliary packs can be quickly attached to and detached from the main pack simply by connecting or disconnecting the male and female fasteners. This permits members of a hiking group to exchange auxiliary packs and share the task of carrying heavier loads.

When an auxiliary pack is detached from the main pack, the female fasteners 37 and male fasteners 40 on the main pack can be connected. This keeps the fasteners out of the way. Further, the capacity of the main pack can be adjusted by pulling on the adjustable straps 41 to tighten the main pack about its contents. This prevents the contents from shifting, thereby preventing the user from becoming unbalanced and/or fatigued.

The auxiliary packs can be conveniently used to store articles which the backpacker might want to use without unpacking the main pack. The auxiliary packs can also be used as separate carrying packs simply by removing the auxiliary packs from the main pack.

The auxiliary packs 12 and 13 are interchangeable. Each pack can be attached to either side of the main pack simply by orienting the pack so that the fasteners mate with the fasteners on the main pack.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A backpack comprising: a main pack having a front portion, a back portion, and a pair of side portions; an auxiliary pack; a first fastener attached to one of said side portions of the main pack adjacent the front portion; a second fastener attached to said one side portion adjacent the back portion; a third fastener removably connected to said first fastener; a fourth fastener removably connected to said second fastener; first adjustable strap means for attaching one of the first and second fasteners to the main pack; second securing strap means for attaching said third and fourth fasteners to said auxiliary pack, whereby the auxiliary pack can be removably attached to the main pack; said first, second, third and fourth fasteners and said first and second strap means defining a, securing and adjusting means which extends from one of the side portions of the main pack adjacent the front portion, around a substantial portion of the auxiliary pack, and to one side portion of the main pack adjacent the back portion for adjusting the capacity of the auxiliary pack and connecting the auxiliary pack to the main pack.

2. The backpack of claim 1 in which said first fastener is adapted to be connected to said second fastener whereby said first and second fasteners can be connected when the auxiliary pack is removed and the capacity of the main pack can be adjusted by adjusting the strap.

3. The backpack of claim 1 in which each of said third and fourth fasteners is attached to the auxiliary pack by a strap.

4. A backpack comprising:

a main pack having a top and a bottom and a front panel, a back panel, and a pair of side panels, a pair of auxiliary packs having a top and a bottom, an upper pair of fasteners attached to each side of the main pack adjacent the top end thereof, one of each of the upper pair of fasteners being attached to the main pack adjacent the intersection of the front and side panels and the other upper fastener being attached to the main pack adjacent the intersection of the back and side panels, one of each of the upper pair of fasteners being attached to the main pack by an adjustable strap, a lower pair of fasteners attached to each side of the main pack adjacent the bottom thereof, one of each of the lower pair of fasteners being attached to the main pack adjacent the intersection of the front and side panels and the other lower fastener being attached to the main pack adjacent the intersection of the back and side panels, one of each of the lower pair of fasteners being attached to the main pack by an adjustable strap, an upper pair of fasteners attached to each auxiliary pack adjacent the top thereof, a lower pair of fasteners attached to each auxiliary pack adjacent the bottom thereof, whereby each auxiliary pack can be removably attached to the main pack by connecting the upper fasteners on the main pack to the upper fasteners on the auxiliary pack and by connecting the lower fasteners on the main pack to the lower fasteners on the auxiliary pack and whereby the capacity of each auxiliary pack can be adjusted by adjusting said adjustable straps, each of said upper and lower pairs of fasteners on the main pack and the auxiliary pack includes a male fastener and a female fastener whereby the male and female fasteners of each pair of fasteners on the main pack can be connected when the auxiliary packs are removed and the capacity of the main pack can be adjusted by adjusting said adjustable straps.

5. A backpack comprising:

a main pack having a top and a bottom and a front panel, a back panel, and a pair of side panels, a pair of auxiliary packs having a top and a bottom, an upper pair of fasteners attached to each side of the main pack adjacent the top end thereof, one of each of the upper pair of fasteners being attached to the main pack adjacent the intersection of the front and side panels and the other upper fastener being attached to the main pack adjacent the intersection of the back and side panels, one of each of the upper pair of fasteners being attached to the main pack by an adjustable strap, a lower pair of fasteners attached to each side of the main pack adjacent the bottom thereof, one of each of the lower pair of fasteners being attached to the main pack adjacent the intersection of the front and side panels and the other lower fastener being attached to the main pack adjacent the intersection of the back and side panels, one of each of the lower pair of fasteners being attached to the main pack by an adjustable strap, an upper pair of fasteners attached to each auxiliary pack adjacent the top thereof, a lower pair of fasteners attached to each auxiliary pack adjacent the bottom thereof, an intermediate pair of fasteners attached to each side of the main pack, one of each pair of the intermediate fasteners being attached to the main pack adjacent the intersection of the front and side panels and the other intermediate fastener being attached to the main pack adjacent the intersection of the back and side panels, one of each of the intermediate fasteners being attached to the main pack by an adjustable strap, and an intermediate pair of fasteners attached to each auxiliary pack, whereby each auxiliary pack can be removably attached to the main pack by connecting the upper fasteners on the main pack to the upper fasteners on the auxiliary pack and by connecting the lower fasteners on the main pack to the lower fasteners on the auxiliary pack and whereby the capacity of each auxiliary pack can be adjusted by adjusting said adjustable straps.

* * * * *